US008157669B2

(12) United States Patent
Hulock et al.

(10) Patent No.: US 8,157,669 B2
(45) Date of Patent: Apr. 17, 2012

(54) MULTI-SECTIONAL CO-CURED GOLF SHAFT

(75) Inventors: Richard P. Hulock, Wheaton, IL (US); Jon C. Pergande, Arlington Heights, IL (US); Robert T. Thurman, Plainfield, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 216 days.

(21) Appl. No.: 12/456,326

(22) Filed: Jun. 15, 2009

(65) Prior Publication Data

US 2010/0317457 A1 Dec. 16, 2010

(51) Int. Cl.
*A63B 53/10* (2006.01)

(52) U.S. Cl. ..... 473/320; 473/316; 473/319

(58) Field of Classification Search ..... 473/320, 473/316, 319

See application file for complete search history.

(56) References Cited

U.S. PATENT DOCUMENTS

| | | | | |
|---|---|---|---|---|
| 4,082,277 | A | 4/1978 | Van Auken et al. | |
| 4,188,032 | A | 2/1980 | Yanagioka | |
| 4,836,545 | A * | 6/1989 | Pompa | 473/320 |
| 5,253,867 | A | 10/1993 | Gafner | |
| 5,496,029 | A | 3/1996 | Heath et al. | |
| 5,695,408 | A * | 12/1997 | DeLaCruz et al. | 473/300 |
| 5,971,865 | A * | 10/1999 | Shenoha et al. | 473/316 |
| 6,203,447 | B1 | 3/2001 | Dillard | |
| 6,302,806 | B1 | 10/2001 | Hsu | |
| D466,575 | S | 12/2002 | Hedrick et al. | |
| 6,582,320 | B2 * | 6/2003 | Fendel | 473/312 |
| 6,729,970 | B2 | 5/2004 | Horwood et al. | |
| 6,805,642 | B2 | 10/2004 | Meyer | |
| D507,815 | S | 7/2005 | Hedrick et al. | |
| 7,115,045 | B2 | 10/2006 | Horwood et al. | |

(Continued)

FOREIGN PATENT DOCUMENTS

GB 1076384 7/1967

(Continued)

OTHER PUBLICATIONS

Nippon Shaft USA website, N. S. PRO 750GH Steel Shaft, http://www.nipponshaft.com/steel_750gh.html.

(Continued)

*Primary Examiner* — Gene Kim
*Assistant Examiner* — Michael Dennis
(74) *Attorney, Agent, or Firm* — Terence P. O'Brien

(57) ABSTRACT

A shaft for a golf club having a total length and a total weight. The shaft includes first and second tubular portions. The first and second tubular portions are formed of first and second materials, respectively. The second tubular portion has a proximal end and a tip end. The tip end has an outside diameter of less than 0.400 inches. The distal end of the first tubular portion is co-cured to the proximal end of the second tubular portion. The shaft has a resistance to twisting about a longitudinal axis of the shaft, when tested under a torsional stability test and measured at an approximate midpoint of the total length of the shaft, of less than 2.0 degrees in a torsional stability test. The shaft when measured from the tip end of the shaft in a balance point test device has a balance point of less than 46 percent.

40 Claims, 7 Drawing Sheets

U.S. PATENT DOCUMENTS

| | | | | |
|---|---|---|---|---|
| 2001/0001772 | A1 | 5/2001 | Fendel | |
| 2002/0082111 | A1* | 6/2002 | Hedrick et al. | 473/316 |
| 2002/0128087 | A1 | 9/2002 | Tilley | |
| 202/0155898 | A1 | 10/2002 | Uebelhor | |
| 2003/0176236 | A1 | 9/2003 | Fendel | |
| 2004/0043825 | A1 | 3/2004 | Horwood | |
| 2006/0046867 | A1 | 3/2006 | Murphy | |
| 2006/0084520 | A1 | 4/2006 | Lindner | |

FOREIGN PATENT DOCUMENTS

| | | |
|---|---|---|
| GB | 2407519 B | 4/2006 |
| WO | WO86/06286 | 11/1986 |

OTHER PUBLICATIONS

True Temper Technology Bi Matrx Rx i Golf Shaft (3 images attached).

* cited by examiner

MULTI-SECTIONAL CO-CURED GOLF SHAFT

FIELD OF THE INVENTION

The present invention relates generally to a shaft for a golf club. In particular, the present invention relates to a golf shaft including a tip portion and a butt end portion formed of different materials.

BACKGROUND OF THE INVENTION

Shafts for golf clubs are well known. Golf shafts are typically specified in terms of flexibility, e.g., stiff flex versus regular flex, and are typically formed from one of two different material categories: steel or graphite. Golf shafts made of steel generally have higher torsional stability than graphite shafts and can transmit vibrational energy more directly from the club head to the user's hands during use. The higher torsional stability and stiffness of steel shafts offers golfers greater control and accuracy and provide golfers with a greater sense of the location of the clubhead during his or her swing. Additionally, the transmission of vibrational energy from the clubhead to the hands of the user is desirable to some golfers who what to maximize their ability to feel the club's contact with the ball. For these reasons, most golfers prefer steel shafts. Over the last decade, more than two-thirds of iron golf club sets have included shafts made of steel. However, steel golf shafts also have some drawbacks. Steel is heavier than graphite. This additional weight can have an undesirable affect on the swing speed of some golfers. Other golfers can find steel shafts to be too heavy, especially when used over the course of an entire round of play. Steel golf shafts can also be too stiff for some golfers. While other golfers can find steel shafts too uncomfortable because too much vibrational energy is transmitted from the club head to the golfer's hands during use.

Golf shafts made of graphite provide the potential benefit of greater flexibility, lower weight and better feel to many golfers. Generally, a greater range of design configurations exist for graphite shafts thereby providing the opportunity for a wider range of options for golfers including variations in the flexibility of the shafts. The lower weight of graphite shafts enables many golfers to increase their swing speed and can reduce golfer fatigue. Graphite golf shafts also dampen a greater amount of vibrational energy generated from contact with a golf ball thereby providing a more comfortable feel for most golfers. However, like steel shafts, graphite golf shafts also have drawbacks. Graphite golf shafts are generally less stable, and provide less torsional stability, than steel shafts. Accordingly, a typical graphite shaft offers less control and accuracy than a steel shaft. Some golfers find graphite shafts to be too light or too flexible. Graphite shafts can be less durable and, in some instances, can provide inconsistent performance.

Thus, a continuing need exists for a shaft of a golf club that provides the benefits of a steel shaft construction and a graphite shaft construction without the drawbacks associated with these materials. What is needed is a golf shaft that weighs less and provides comparable torsional stability and accuracy to a steel shaft. It is desirable to provide a golf shaft with improved accuracy, stability and control and also providing an improved feel to the golfer. Further, a continuing need also exists to produce a golf shaft with an improved aesthetic.

SUMMARY OF THE INVENTION

The present invention provides a shaft for a golf club. The shaft has a longitudinal axis and is capable of being tested under a torsional stability test device. The test device has a first support and a torsional load applicator. The shaft includes a first tubular portion formed of a first material, wherein the first tubular portion has a butt end and a distal end. A second tubular portion is formed of a second material different from the first material. The second tubular portion has a proximal end and a tip end. The tip end has an outside diameter of less than 0.400 inches. The distal end of the first tubular portion is coupled to the proximal end of the second tubular portion. The shaft has a resistance to twisting about the longitudinal axis of the shaft of less than 2.5 degrees, when measured in the torsional stability test device at a point 20 inches from the first support along the exposed length of the shaft. The first support is fixedly secured to approximately 2.25 inches of the shaft at the tip end of the first tubular portion, and the torsional load applicator applies a 1 ft-lb torque to the butt end of the second tubular portion of the shaft.

According to a principal aspect of a preferred form of the invention, a shaft for a golf club has a total length and includes a first hollow tubular portion formed of a first composite material and a second hollow tubular portion formed of a second metallic material. The first tubular portion has a butt end region and a tapered distal end region. The first composite material includes a galvanic corrosion inhibitor layer positioned as the innermost layer of at least a portion of the tapered distal end region. The first tubular portion extends over at least forty percent of the total length of the shaft. The second tubular portion has a tapered proximal end region and a tip end region. At least a portion of the outer surface of the tapered proximal end region is roughened. The first composite material of the first tubular portion is co-cured to the outer surface of the tapered proximal end region of the second tubular portion. The second tubular portion extends over at least forty percent of the total length of the shaft. The first tubular portion overlaps the second tubular portion to form an overlapped region. The overlapped region is at least one inch and less than four inches in length.

According to another preferred aspect of the invention, a golf club includes a shaft, a club head and a grip. The shaft includes a first tubular portion formed of a first material and a second tubular portion formed of a second material. The first tubular portion has a butt end and a distal end. The second tubular portion has a proximal end and a tip end. The distal end of the first tubular portion is coupled to the proximal end of the second tubular portion. The first tubular portion has a weight of within the range of 1.1 to 1.75 grams/inch, and the second tubular portion having a weight within the range of 2.0 to 2.8 grams/inch. The shaft has a balance point of less than 46 percent when measured in a balance point test device from the tip end of the shaft. The club head is coupled to the tip end of the second tubular portion. The grip is attached to the first tubular portion.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
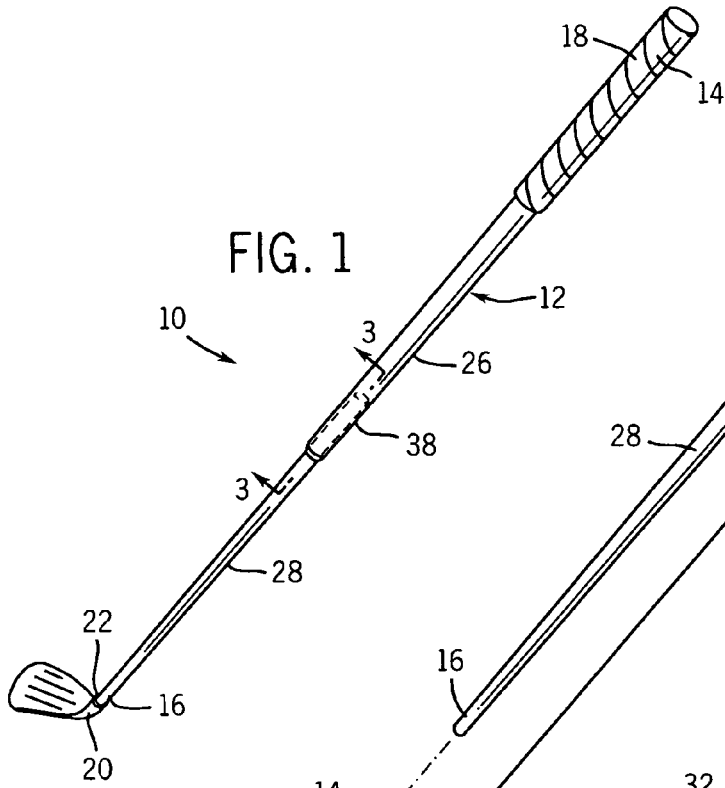
FIG. 1 is a side perspective view of an iron golf club in accordance with a preferred embodiment of the present invention.

Referring to FIG. 1, a golf club is indicated generally at 10. The golf club 10 of FIG. 1 is configured as a #6 iron type club of a set. The present invention can also be formed as, and is directly applicable to, #2 through #9 iron clubs, fairway woods, drivers, hybrids, wedges and combinations thereof in sets of golf clubs. The golf club 10 is an elongate implement configured for striking a golf ball and includes a golf shaft 12 having a butt end 14 and a tip end 16, a grip 18 coupled to the butt end 14, and a club head 20 coupled to the tip end 16.

The grip 18 is a conventional handle structure of generally hollow construction. The grip 18 has an open end configured for slidably receiving the butt end 14 of the shaft 12. The grip 18 is formed of a generally soft resilient material, such as, for example, rubber, polyurethane, leather, a thermoplastic, an elastomer, or combinations thereof. Alternatively, the grip 18 can be formed of two or more layers of material. In yet another alternative embodiment, the grip 18 be can formed by wrapping of one or more tapes about the butt end 14 of the shaft 12.

The club head 20 is a generally planar body that is coupled to the shaft 12. Preferably, the club head 20 is affixed to the shaft 12 with an epoxy adhesive. A ferrule 22 can be used to generally cover a portion of the connection of the club head 20 to the shaft 12 and to improve the profile and general appearance of the connection of the club head 20 to the shaft 12. The club head 20 is typically formed of a high tensile strength, durable material, preferably stainless steel. Alternatively, the club head 20 can be formed of other materials such as, for example, other metals, alloys, ceramics, composite materials, or combinations thereof.

Referring to FIGS. 2-5, the shaft 12 is shown in greater detail. The shaft 12 is an elongate hollow tube extending along a longitudinal axis 24 formed of first and second tubular portions 26 and 28. The first tubular portion 26 includes the butt end 14 and a distal end 30. The first tubular portion 26 is formed of a first material that is lightweight and strong, preferably a composite material. In alternative embodiments, the first tubular portion can be formed of other materials such as, ceramic, wood, steel, thermoset polymers, thermoplastic polymers, titanium alloys, and other alloys. The shaft of the present invention is a multi-sectional golf shaft. As used herein, the term "multi-sectional" golf shaft refers to a golf shaft formed of two or more portions or sections. In a preferred embodiment, the shaft is formed of the first and second tubular portions 26 and 28. In other preferred embodiments, one or more center or intermediate portions can be used to couple the first and second tubular portions together.

As used herein, the term "composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In multiple layer constructions, the fibers can be aligned in different directions with respect to the longitudinal axis 24, and/or in braids or weaves from layer to layer. The layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-para-phenylene-2,6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers.

Figure 8:
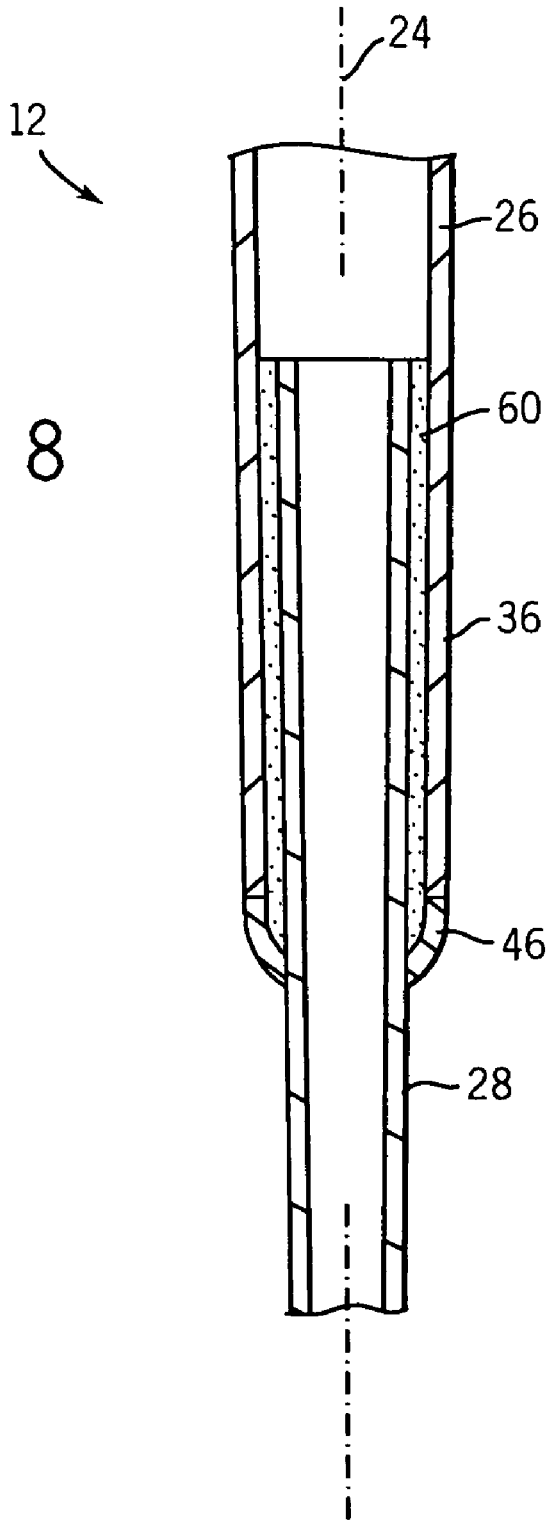
FIG. 8 is a longitudinal, cross-sectional view of a central region of a golf shaft in accordance with an alternative preferred embodiment of the present invention.

In a preferred embodiment, the innermost layer 32 of the first material of the first tubular portion 26 at or near the distal end 30 is a galvanic corrosion inhibitor layer. In one particularly preferred embodiment, the galvanic corrosion inhibitor layer 32 is formed with glass fibers. In alternative preferred embodiments, other types of fibers can be used. Referring to FIG. 8, in another alternative preferred embodiment, a coating or protective layer 60 can be applied, or positioned adjacent, to the inner surface of the first tubular portion 26 at or near the distal end 30 to inhibit galvanic corrosion.

Figure 2:
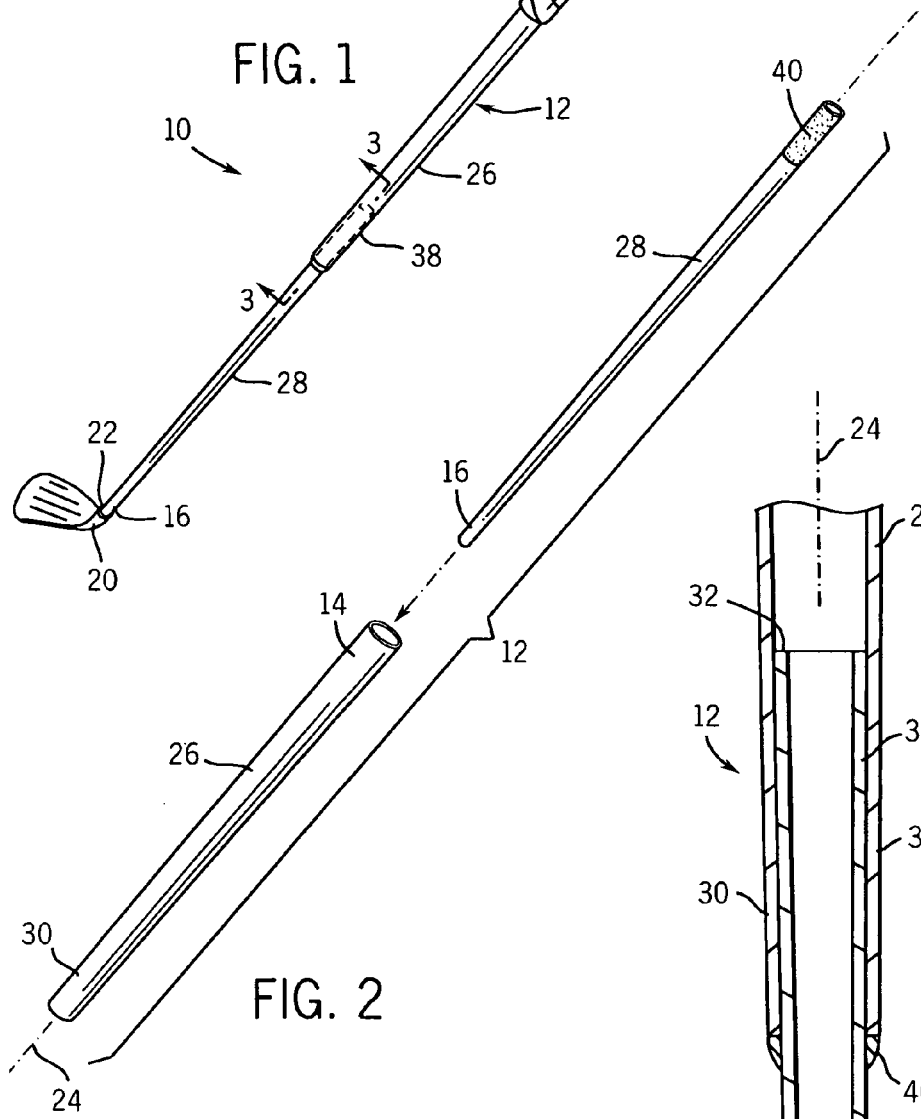
FIG. 2 is a side perspective, exploded view of first and second tubular portions of a shaft of the golf club of FIG. 1 illustrating one preferred method of connecting the first and second tubular portions.
Figure 3:
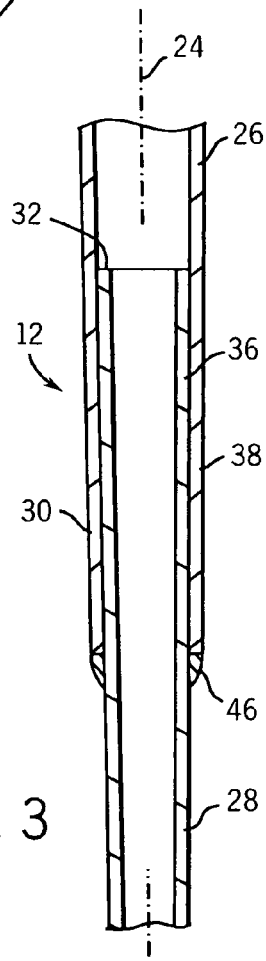
FIG. 3 is a longitudinal, cross-sectional view of a central region of the shaft of the golf club taken along line 3-3 of FIG. 1.
Figure 4:
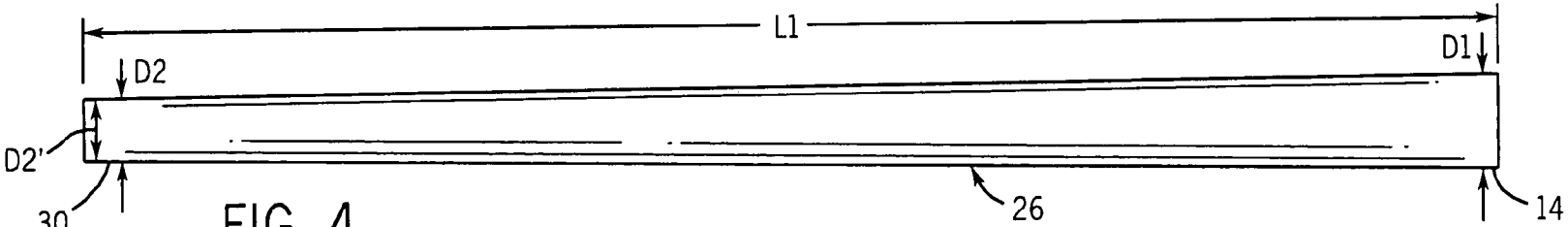
FIG. 4 is a side view of the first tubular portion of the shaft of the golf club of FIG. 1.
Figure 6:
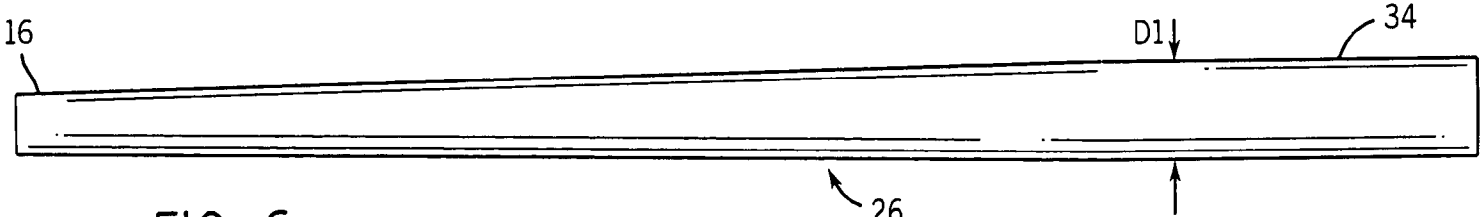
FIG. 6 is a side view of the first tubular portion of the shaft of a golf club in accordance with an alternative preferred embodiment of the present invention.

Referring to FIGS. 2-4, the first tubular portion 26 has a length L1, and preferably has a generally frusto-conical shape extending from at or near the butt end 14 to the distal end 30. The butt end 14 has an outside diameter D1 and the distal end has an outside diameter D2 and an inside diameter D2'. In one embodiment, the outside diameter of the first tubular portion 26 continually decreases along the longitudinal axis 24 from the butt end 14 (D1) to the distal end 30 (D2). Referring to FIG. 6, in an alternative embodiment, a region 34 at or near the butt end 14 of the first tubular portion 26 can have a uniform or generally constant outside diameter along the longitudinal axis 24 for a predetermined distance. In one particularly preferred embodiment, the predetermined distance of the region 34 can be approximately 10 inches. In alternative embodiments, the predetermined distance can be other distances.

Referring to FIG. 4, in one particular preferred embodiment, the outside diameter D1 is within the range of 0.580 to 0.635 inches, and the inside diameter D2' is within the range of 0.470 to 0.530 inches. The inside diameter of the first tubular portion 26 tapers outward from D2' at the distal end 30 toward the butt end 14. The amount of the outward taper of inside diameter of the first tubular portion 26 outwardly extends toward the butt end 14 at a rate within the range of 0.001 to 0.100 inch per inch. In a particularly preferred embodiment, the rate of the taper or increase of-the inside diameter of the first tubular portion 26 from the distal end 30 toward the butt end 14 is within the range of 0.0100 to 0.0150 inch per inch. The length L1 of the first tubular portion 26 is preferably within the range of 14 inches to 28 inches depending on the intended application of the shaft 12. In particularly preferred embodiments, the length L1 is 18 inches, 19 inches and 22.25 inches. Preferably, the length of the first tubular portion 26 represents at least forty percent of the total length of the shaft 12. In other alternative preferred embodiments, other lengths can be used. In alternative preferred embodiments, the first tubular portion can have a stepped profile or regions of uniform diameter such that one or more segments of the first tubular portion are tapered or have the frusto-conical shape as opposed to the entire length of the first tubular portion having a frusto-conical shape.

Figure 5:
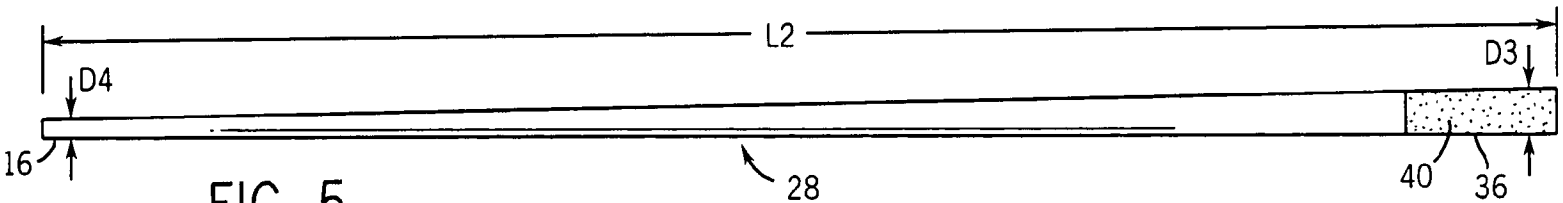
FIG. 5 is a side view of the second tubular portion of the shaft of the golf club of FIG. 1.

Referring to FIG. 5, the second tubular portion 28 has a length L2 and includes a proximal end 36 having an outside diameter D3 and the tip end 16 having an outside diameter D4. The second tubular portion 28 is formed of a second material that is strong and provides a high level of torsional stability, preferably steel. In alternative embodiments, the second tubular portion can be formed of other materials such as, aluminum, titanium, scandium, other alloys and combinations thereof. In other alternative embodiments, the second tubular member can be formed of ceramic, wood, plastic, composite material and combinations thereof. The second material of the second tubular portion 28 is preferably different from the first material of the first tubular portion 26.

Referring to FIGS. 2, 3 and 5, the second tubular portion 28 preferably has a generally frusto-conical shape extending along the longitudinal axis 24 from at or near the proximal end 36 to the tip end 16. In one particular preferred embodiment, the outside diameter D3 is at least 0.490 inches, and most preferably within the range of 0.490 to 0.550 inches. The outside diameter of the second tubular portion 28 tapers inward from D3 at the proximal end 36 toward the tip end 16. The amount of the inward taper of outside diameter of the second tubular portion 28 extends from the proximal end 36 toward the tip end 14 at a rate within the range of 0.001 to 0.100 inch per inch. In a particularly preferred embodiment, the rate of the taper or decrease of the outside diameter of the second tubular portion 28 from the proximal end 36 toward the tip end 14 is within the range of 0.010 to 0.015 inch per inch. The outside diameter D4 is preferably less than 0.400 inches. In another particular preferred embodiment, the outside diameter D4 is less than 0.400 inches and greater than 0.325 inches. In another preferred embodiment, the outside diameter D4 can be in the range of 0.325 to 0.505 inches. The length L2 of the second tubular portion is preferably within the range of 18 inches to 30 inches depending on the intended application of the shaft 12. In particularly preferred embodiments, the length L2 is 25 inches, 21 inches and 22 inches. Preferably, the length of the second tubular portion 28 represents at least forty percent of the total length of the shaft 12. In other alternative preferred embodiments, other lengths can be used. In alternative preferred embodiments, the second tubular portion can have a stepped profile or regions of uniform diameter such that one or more segments of the second tubular portion are tapered or have the frusto-conical shape as opposed to the entire length of the second tubular portion having a frusto-conical shape.

The second tubular portion 28 has an outer surface that diverges outwardly from the longitudinal axis 24 from the tip end 16 toward the proximal end 36 in a configuration complementary to the inner surface of the first tubular portion 26 that converges toward the longitudinal axis from the butt end 14 to the distal end 30. The outside diameter D3 is preferably larger than the inside diameter D2' thereby preventing the second tubular portion 28 from extending entirely through the first tubular portion 28 if the second tubular portion 28 is inserted tip end 16 first into the butt end 14 of the first tubular portion 26. The size and tapered or frusto-conical shapes of the first and second tubular portions 26 and 28 enables the second tubular portion 28 to be inserted into the butt end 14 of the first tubular portion 26 so that the tip end 16 and a large percentage of the length L2 of the second tubular portion 28 extends through the distal end 30 of the first tubular portion 26, but the second tubular portion 28 cannot entirely pass through the first tubular portion 26. A region of the second tubular portion 28 mechanically engages the inside surface of the first tubular portion 26 at or near the distal end 30 forming a mechanical lock and an overlapped region 38. The overlapped region 38 has a length sufficient to provide a strong reliable connection between the first and second tubular portions 26 and 28. In preferred embodiments, the overlapped region 38 has a length between 0.5 to 10 inches. In a more preferred embodiment, the overlapped region 38 has a length between 1.0 to 4.0 inches, and in a particularly preferred embodiment, the overlapped region has a length within the range of 2.0 to 2.5 inches.

In FIG. 2, one method of assembling the present invention is illustrated wherein the first tubular portion 26 is preformed and the second tubular portion 28 is slid into the opening of the butt end 14 of the shaft 12 such that the tip end 16 and a large amount of the second tubular portion 28 extends entirely through, and out of the distal end 30 of, the first tubular portion 26. The corresponding frusto-conical shapes of the inner surface of the first tubular portion 26 and the outer surface of the second tubular portion 28 engage each other and form the mechanical lock.

The outer surface of the second tubular portion 28 at or near the proximal end 36 is preferably roughened or etched, forming a roughened area 40, to facilitate the connection of the first and second tubular portions at the overlapped region 38. In one preferred embodiment, the second tubular portion 28 is formed of chrome plated steel and the chrome-plating etched, scraped or otherwise removed to form the roughened area 40.

Figure 7:
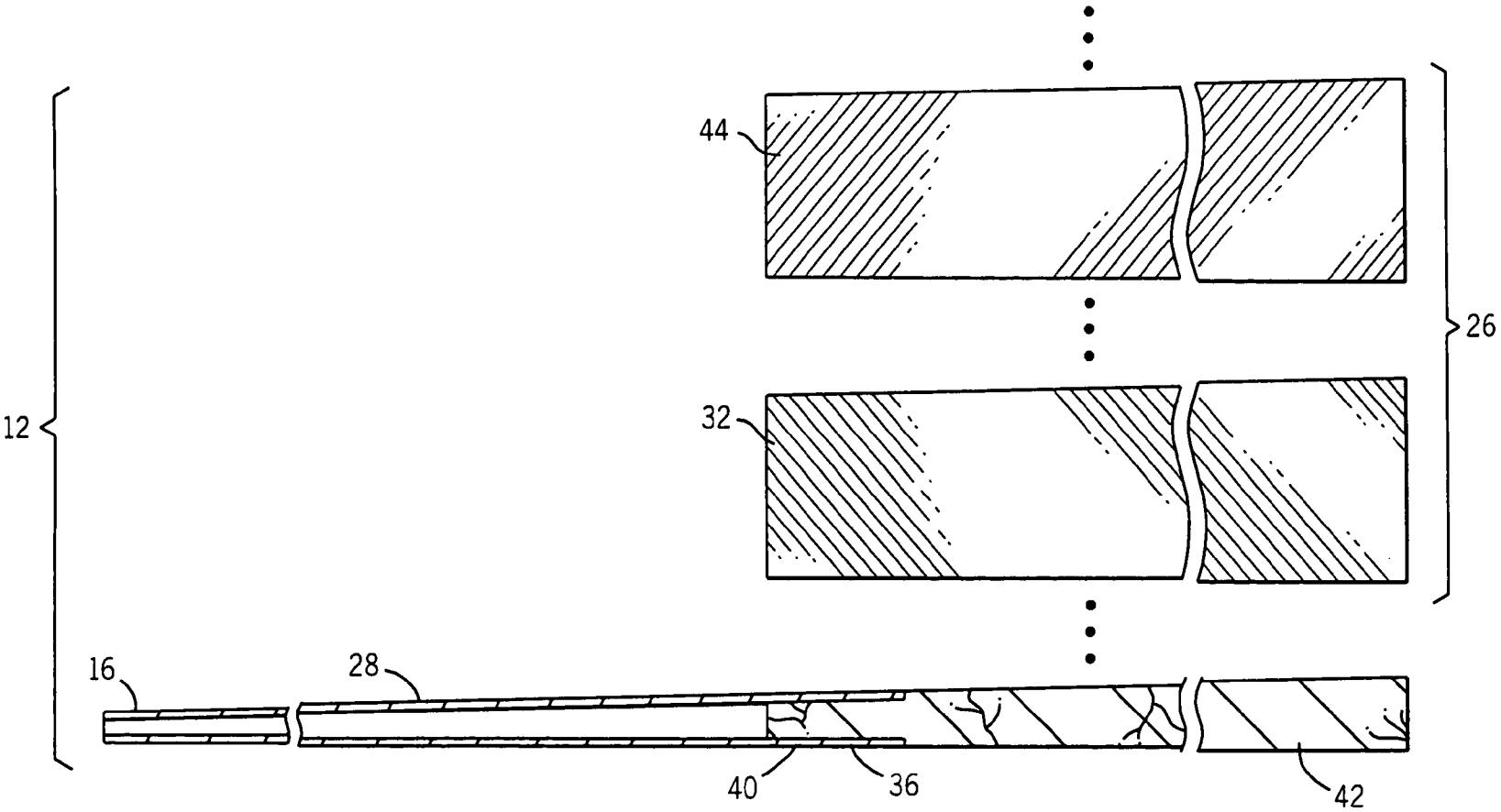
FIG. 7 is an exploded view of the first and second tubular portions of the shaft of FIG. 2 illustrating the formation of the first tubular portion and its engagement with the second tubular portion using co-curing in accordance with a preferred embodiment of the present invention.

Referring to FIG. 7, in one preferred embodiment, the first tubular portion 26 is co-cured to the second tubular portion 28. With respect to the present invention, the term "co-cured" shall mean the wrapping and curing of at least a portion of one or more layers of composite material over a finished component of a product. In particular, co-cured refers to the wrapping and curing of one or more layers of composite material over the proximal end 34 of the second tubular portion 28. Co-curing provides an exceptional connection between the composite material and the proximal end 34 of the second tubular portion 28. Co-curing provides a more uniform and consistent bond-line than other connection types. The improved connection of the two components provided by co-curing improves the integrity and durability of the connection.

In this preferred embodiment, a mandrel 42 is configured to fit into the second tubular portion 28 at the proximal end 34 and shaped to define the inner surface of the first tubular portion 26 excluding the overlapped region 36. The mandrel 40 can be formed of any material that maintains its shape and integrity during the curing process. Once the mandrel 42 is properly position the process of "laying up" the layers comprising the composite material is performed. The inner surface of the first tubular portion 26 at or near the distal end 30 is formed by wrapping the one or more layers of composite material directly over the roughened area 40 of the second tubular portion 28. In particular, the innermost layer 32 of the composite material, preferably a galvanic corrosion inhibiting layer, can be wrapped about the outer surface of the second tubular portion 28 at the roughened area 40 and over at least a portion of the outer surface of mandrel 42. Additional layers of composite material, such as layer 44, can then be wrapped over the innermost layer 32 to form the first tubular portion 26. The shape and overall size of the layers, such as layers 32 and 44, can vary from one to another. The lay-up including the second tubular portion 28, the mandrel 40 and the wrapped composite layers 32 and 44 are heated and cured to form the first tubular portion 26. After curing, the mandrel 42 is removed from the inner surface of the shaft 12 through conventional means, such as, for example, extraction or heating.

Thus, the first tubular portion 26 is preferably wrapped and formed over the second tubular portion 28 at the roughened area 40 and co-cured to the second tubular portion 28 to form the shaft 12. The process described above of laying up and curing the layers of material over the roughened area 40 of the second tubular portion 28 is a preferred method of connecting the first and second tubular portions 26 and 28. A portion of the composite material of the first tubular portion 26 is cured over the roughened area 40 of the second tubular portion 28 to form a co-cured joint between the first and second tubular portions 26 and 28. In this process, the co-cured connection of the first and second tubular portions 26 and 28 is formed without the use of separate adhesives. In alternative preferred embodiments, one or more separate adhesives can be used to facilitate the connection of the first and second tubular portions 26 and 28.

The connection of the first and second tubular portions 26 and 28 assists in dampening unwanted shock and/or vibrational energy generated from impact of the club head to the ball from as it extends up and along the shaft 12 to the user's hands. The transition from the dissimilar first and second materials at the overlapped region 38 serves to dampen or lessen the severity of the shock and/or vibrational energy.

Referring to FIG. 8, in an alternative preferred embodiment, an additional layer 60 of dampening material can be positioned or applied between the first and second tubular portions 26 to further dampen, reduce and/or mitigate the vibrational and shock energy as it travels along the shaft 12 following impact with a golf ball. The additional layer 60 preferably extends about the entire overlapping region 38 such that the layer 60 separates the first tubular portion 26 from the second tubular portion 28. The additional layer 60 can be a foam layer, a sleeve, a tape or any form of dampener. The additional layer 60 is preferably formed of a resilient material, such as, for example, an elastomeric material. Alternatively, other materials can be used such as, for example, a rubber, a thermoset material, a plastic, a polymeric material and combinations thereof.

Referring to FIG. 3, the shaft 12 preferably further includes a protective ferrule 46 that covers at least a portion of the transition between the distal end of the first tubular portion 26 and the second tubular portion 28. The ferrule 46 can be formed of any durable material, such as, a plastic. Alternatively, the ferrule can also be made of a composite material, aluminum, an elastomeric material, a metal, a ceramic, wood and combinations thereof. The ferrule 46 provides a more aesthetically pleasing appearance to the transition area of the shaft 12.

The assembled shaft 12 can be configured to a variety of different lengths depending upon the particular application. The weight of the shaft 12 can also be varied to adjust for a particular application or golfer preference. The first tubular portion 26 preferably has a weight within the range of 1.1 to 1.75 grams/inch. The second tubular portion 28 preferably has a weight within the range of 2.0 to 2.8 grams/inch. In alternative preferred embodiments, weight per inch of the first and/or second tubular portions can fall outside of these ranges. The weight of the shaft as a whole is preferably within the range of 45 to 95 grams. In one particularly preferred embodiment, the shaft can have a weight within the range 65 to 85 grams. The shaft 12 of the present invention generally provides for an overall shaft weight that is close to or the same as full graphite shafts. Unlike full graphite, the shaft 12 of the present invention provides many of the benefits of an all steel shaft without the negative characteristics often associated with steel.

The shaft 12 provides the unique advantage of having a balance point measurement that is less than fifty percent (50%) when measured from the tip end 16 of the shaft 12 using a conventional golf shaft balance board ("a balance point test device"). In a particularly preferred embodiment, the balance point of the shaft 12 is less than forty-six (46%). The balance board (or the balance point test device) used to measure balance point has a major dimension and an adjustable fulcrum extending about the board in a direction transverse to the major dimension. When measuring balance point, the shaft 12 is placed upon the board such that the longitudinal axis 24 of the shaft is generally parallel to the major dimension and over the adjustable fulcrum. The balance board preferably includes a ruler or other markings indicating distance (e.g., inches). The adjustable fulcrum is repositioned until the shaft 12 is balanced solely on the adjustable fulcrum and not on the surface of the balance board. The balance point distance from the tip end 16 to the balance point (location of the adjustable fulcrum adjacent the shaft) of the shaft 12 is measured. The balance point distance is then divided by the total length of the shaft 12 to obtain the balance point in terms of a percentage.

As stated above, the balance point of the shaft 12 of the present invention is less than 50% and preferably less than 46%. In two particularly preferred embodiments, two shafts built in accordance with the present invention have shaft weights of 90 grams and 82 grams, respectively. Each of the two shafts has a precut length of 40 inches and a balance point measured from the tip end of 17.83 inches and 17.30 inches for balance point percentages of 44.6% and 43.3%, respectively. In contrast, the balance point of existing graphite shafts and steel shafts is greater than 50%. The uniquely positioned balance point of the shaft 12 of the present invention enables the shaft 12 to be matched with a corresponding club head and grip to provide a swingweight that is comparable to a swingweight of a steel shafted golf club but with a lighter club weight. As a result, the present shaft 12 can enable a golfer to maintain the same stable feel of the higher swingweight club while also achieving greater clubhead speed due to the decreased weight of the shaft compared to weight of the golf club having a steel shaft. The reduced weight also reduces the likelihood of the golfer becoming fatigued over the course of a round.

Swingweight is a measure of how the weight of a golf club feels when it's swung. In particular, swingweight is the measurement of a golf club's weight about a fulcrum point which is established at a specified distance from the grip end of the club. It is generally desirable to use a set of golf clubs with comparable swingweights. Swingweight is not equal or equivalent to actual weight of a golf club. However, the actual weight of existing clubs typically increases as a club's swingweight increases (and vice versa). Swingweight is expressed in terms of a letter and number (e.g., "D5"). The letters used are A, B, C, D, E, F and G, and the numerals are 0, 1, 2, 3, 4, 5, 6, 7, 8, 9 and 10. Each letter/number combination is known as a "swingweight point," and there are 77 possible swingweight measurements. A0 is the lightest measurement, progressing up to the heaviest, G10. A standard or nominal swingweight for men's clubs can be D0 to D2 or C8 to D4, and for women's clubs, C5 to C7 or C3 to C9. Another commonly applied swingweight range can be in the range of C8 to D4. Low handicap golfers generally prefer clubs having higher swingweights because such clubs typically offer more control over the movement of the club and can provide a more acute sense of the feel of the club head. These higher swingweight clubs typically also have higher actual weights, such as steel shafted golf clubs.

The shaft 12 of the present invention provides the unique benefit of enabling the golfer to obtain his or her desired swingweight with a club that has a reduced actual weight due to the reduced weight of the shaft 12. With the reduced actual (or overall) weight, the golfer can continue to use a club having his or her desired swingweight, but, due to the reduced actual weight of the club, now has the ability, if desired, to swing the club faster. The golfer therefore can obtain increased clubhead speed and the corresponding performance benefits (e.g. increased ball speed and increased distance).

The ability of a golfer to obtain greater club head speed typically results in greater ball speed off the club. Table 1 below demonstrates this result. Two Wilson® Ci7™ six iron club heads having the same club head weight were attached to two separate shafts (a steel shaft having a weight of 105 grams and a shaft built in accordance with the present invention having a weight of 82 grams). The two clubs were then used and compared by 16 golfers at a test range. The golfers were low to mid-range handicap golfers having consistent ball striking skills. The golfers' club head speed and ball speed were monitored and recorded using a Trackman™ swing and ball flight analyzer commonly used in the Industry. The Trackman™ analyzer is produced and sold by ISG A/S of Vedbaek, Denmark. The average club head speed measured at impact and average ball speed immediately following impact for the group of golfers was obtained and is listed in Table 1.

| CLUB | CLUB HEAD SPEED (mph) | BALL SPEED (mph) | SHAFT WEIGHT (grams) | CLUB HEAD WEIGHT (grams) |
|---|---|---|---|---|
| Wilson ® Ci7 ™ 6-Iron - Steel Shaft | 85.5 | 115.4 | 105 | 261 |
| Wilson ® Ci7 ™ 6-Iron - Shaft Built in Accordance with Present Invention | 87.0 | 117.1 | 82 | 261 |

In one preferred embodiment, a golf club 10 can have a swingweight rating within the range of C8 to D4 and a corresponding actual weight within the range of 335 to 430 grams. In a particularly preferred embodiment, an iron golf club (e.g. a Wilson® Ci7™ 3-iron golf club) has an actual weight within the range of 340 to 370 grams, a length within the range of 38.5 to 40.0 inches, a loft angle of 16 to 24 degrees, a swingweight rating within the range of C8 to D4, and a club head weight within the range of 218 to 248 grams. In another particularly preferred embodiment, an iron golf club (e.g. a Wilson® Ci7™ 6-iron golf club) has an actual weight within the range of 355 to 385 grams, a length within the range of 37 to 38.5 inches, a loft angle of 26 to 34 degrees, a swingweight rating within the range of C8 to D4, and a club head weight within the range of 234.5 to 264.5 grams. In yet another particularly preferred embodiment, an iron golf club (e.g. a Wilson® Ci7™ 9-iron golf club) has an actual weight within the range of 385 to 415 grams, a length within the range of 35.5 to 37.0 inches, a loft angle of 38 to 46 degrees, a swingweight rating within the range of C8 to D4, and a club head weight within the range of 263 to 293 grams. In yet another particularly preferred embodiment, a hybrid golf club (e.g. a Wilson® D-Fy™ hybrid golf club) has an actual weight within the range of 335 to 365 grams, a length within the range of 38.5 to 41.5 inches, a loft angle of 18 to 27 degrees, a swingweight rating within the range of C8 to D4, and a club head weight within the range of 215 to 245 grams. In still another particularly preferred embodiment, a sand wedge (e.g. a Wilson® Tw9™ sand wedge) has an actual weight within the range of 400 to 430 grams, a length within the range of 35.0 to 36.5 inches, a loft angle of 52 to 60 degrees, a swingweight rating within the range of C8 to D4, and a club head weight within the range of 279 to 309 grams.

In other alternative preferred embodiments, golf clubs of varying lengths, weights, and lofts can be used with other swingweight ranges, such as, for example, C3 to C9 or C5 to C7 for women. In another alternative preferred embodiment, a set of irons may have 1, 2 or more irons with golf shafts constructed in accordance with the present invention, while the remaining clubs can have a steel or graphite type of shaft.

Figure 9:
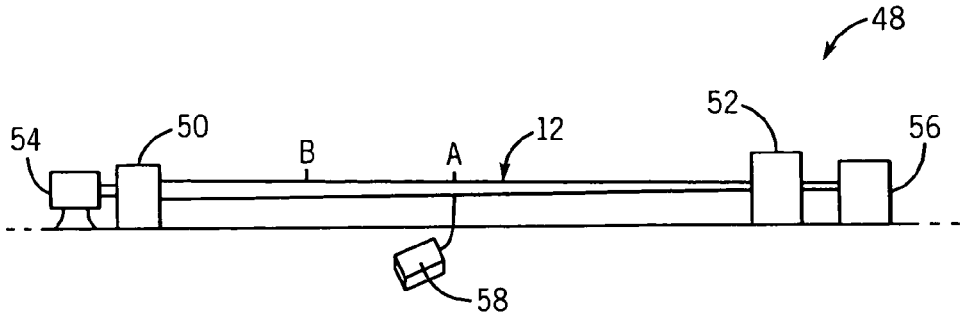
FIG. 9 is a side view of a torsional stability test device.

The shaft 12 of the present invention also provides exceptional resistance to twisting characteristics when the shaft 12 is tested under a torsional stability test device 48. Referring to FIG. 9, the torsional stability test device 48 includes a butt end support 50 and a tip end support 52 configured to support the shaft in a substantially horizontal position. The butt end and tip end supports 50 and 52 are clamped to the butt end 14 and tip ends 16 of the shaft 12, respectively. Each of the butt end and tip end supports 50 and 52 are configured to clamp approximately 2.25 inches of the shaft at the butt and tip ends of the shaft, respectively. The butt end support 50 is coupled to a rotatable torque applicator 54 configured to rotate the butt end support 50 thereby applying a torque to the shaft 12. The tip end support 52 is operably connected to a transducer 56. The tip end support 52 retains the tip end 16 of the shaft 12 in a fixed position as the torque is applied to the shaft via rotation of the butt end support 50. In a preferred embodiment, approximately 2.25 inches of the tip end 16 of the shaft 12 is clamped by the tip end support 52. In a preferred embodiment, the butt end support 50 engages approximately 2.25 inches of the butt end 14 of the shaft 12. The transducer 56 measures the torque applied to the tip end 16. A shaft torque profile, such as those shown in FIG. 10 can be obtained by placing nine marks on the shaft 12 at four inch increments from the tip end support 52 toward the butt end support 50 (alternatively 6 marks at six inch increments or other marking formats can also be used). The nine marks are applied to the exposed length of the shaft 12 exposed between the butt end support 50 and the tip end support 52. A digital inclinometer 58 is operably coupled to the shaft 12 at the first of the nine marks. The inclinometer 58 is zeroed and a torque is applied by the rotatable torque applicator 54 to the butt end 14 of the shaft at the butt end support 50 and twist angle readings from the inclinometer 58 are taken after a torque of 1.0 foot-pounds (ft-lbs) is applied, and after every additional 1 ft-lbs of torque (e.g. 2.0 ft-lbs and 3.0 ft-lbs). This process is repeated for all nine marks along the shaft. The result is a table of twist angle readings at each of the nine marks along the exposed length of the shaft 12 from the tip end support 52 for each of the incremental torque readings. From this data a shaft torque profile (or torsional profile) indicating the shaft's ability to resist twisting about the longitudinal axis 24 of the shaft 12 is obtained.

Figure 10:
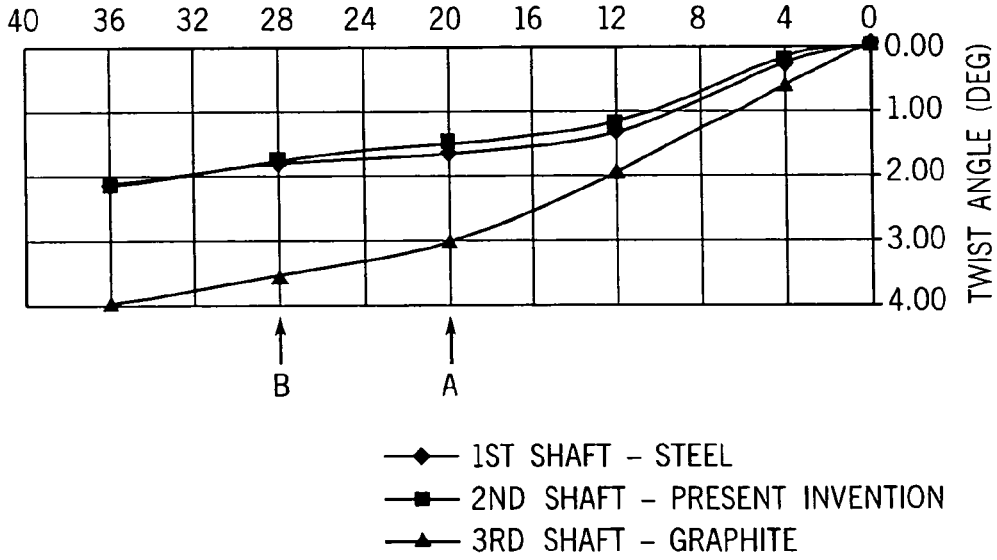
FIG. 10 is a graph illustrating three torque or torsional profiles of three separate golf shafts.

FIG. 10 illustrates the results of three separate torsional profiles taken on three different shaft configurations and are based upon an average torque (or torque load) of 1.0 ft-lbs. Each of the three shafts have comparable lengths, tip end diameters and butt end diameters. The tip diameters of the first, second and third shafts are each less than 0.400 inches (e.g.,the tip diameter of each of the first, second and third shafts is 0.370 inches). The first shaft is a steel shaft produced by FST (Far East Machinery Company, Ltd.) of Boulder, Colo. and having a weight of 115 grams. The second shaft is a shaft built in accordance with the present invention having a weight of 90 grams. The third shaft is a graphite shaft under the mark V2™ and is produced by UST Mamiya of Fort Worth, Tex. The third shaft has a weight of 65 grams. The torsional profiles demonstrate that the second shaft built in accordance with the present invention provides substantially the same torsional profile and resistance to twisting as a complete steel shaft (the first shaft). The first and second shaft demonstrate exceptional resistance to twisting which provides the golfer with better control and better accuracy, especially on off-center impacts. The first and second shafts enable the golfer to hit the ball consistently straighter.

The shaft of the present invention has a resistance to twisting about the longitudinal axis of the shaft when measured approximately at the midpoint of the total length (and of the exposed length) of the shaft, of less than 2.5 degrees, and preferably less than 2.0 degrees, in the torsional stability test described above. For example, at the 20 inch mark, point A, along the shaft (x-axis of FIG. 10), an approximate mid-point of a forty inch shaft (which is approximately 56 percent of the exposed length of the shaft from the tip end support 52), the first and second shafts have twist angle readings of less than 2.00 degrees (y-axis of FIG. 10), while the third shaft has a twist angle of approximately 3.00 degrees. Further, at a 28 inch mark along the exposed length of the shaft, a point approximately seventy percent (74%) of a forty inch shaft measured from the tip end of the shaft (point B) (which is approximately 79 percent of the exposed length of the shaft from the tip end support 52), the first and second shafts have twist angle readings of less than 2.00 degrees, while the third shaft has a twist angle of approximately 3.50 degrees. In fact, for any point along the length of the shaft that is less than 28 inches along the exposed length of the shaft from the tip end support 52 or approximately 74 percent of the length of the shaft from the tip end of the shaft (e.g. 24 inches or 63.5%, 16 inches or approximately 42%, etc.), the second shaft has a twist angle reading of less than 2.00 degrees. Forty inches is a nominal length for a medium range iron shaft, and typically represents the shaft length prior to cutting the shaft to the desired length. Other shaft lengths can also be used. Further, at a point located 36 inches from the tip end support 52 of the second shaft or any point located less than 36 inches from the tip end support 52 (more notably, from a point located 36 inches from the tip end support 52 to a point located at greater than 20 inches from the tip end support 52), the second shaft has a twist angle reading of less than 3.00 degrees.

Figure 11:
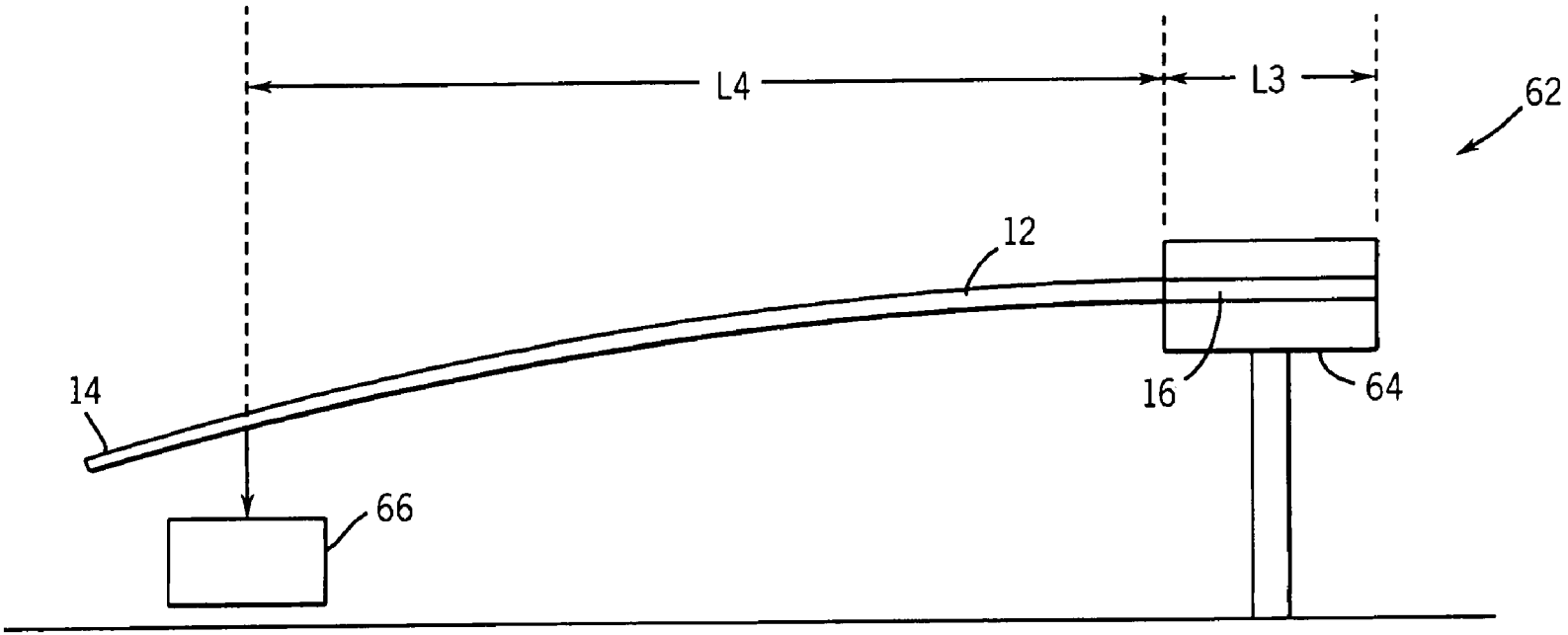
FIG. 11 is a side view of a shaft deflection test device.

The shaft 12 of the present invention also provides flexibility characteristics comparable to graphite or steel shafts when the shaft 12 is tested under a shaft deflection test device 62. Referring to FIG. 11, the shaft deflection test device 48 includes a butt end support 64 configured to support the shaft in a substantially horizontal position. The butt end support 64 is clamped to a third predetermined length, L3, of the butt end 14 of the shaft 12. Preferably, the predetermined length L3 is approximately 5.5 inches of the butt end 14 of the shaft 12 that is fixedly secured by the butt end support 64. The tip end 16 of the shaft 12 is free and unsupported. A load 66, preferably a 6.5 pound load 66, is applied to the shaft at a fourth predetermined distance or length, L4, measured from the butt end support 64 toward the tip end 14 of the shaft 12. In a preferred embodiment, the fourth predetermined length L4 is approximately 29.625 inches from the butt end support 64. The seven pound load 66 causes the shaft 12 to deflect with respect from horizontal. A shaft deflection profile, such as those shown in FIG. 12 can be obtained by placing nine marks on the shaft 12 at four inch increments from the tip end support 52 toward the butt end support 50 (alternatively 6 marks at six inch increments or other marking formats can also be used). The amount of deflection from horizontal is measured at 4 inch increments from the butt end support 64. These points are then plotted to illustrate a deflection profile for the shaft 12.

Figure 12:
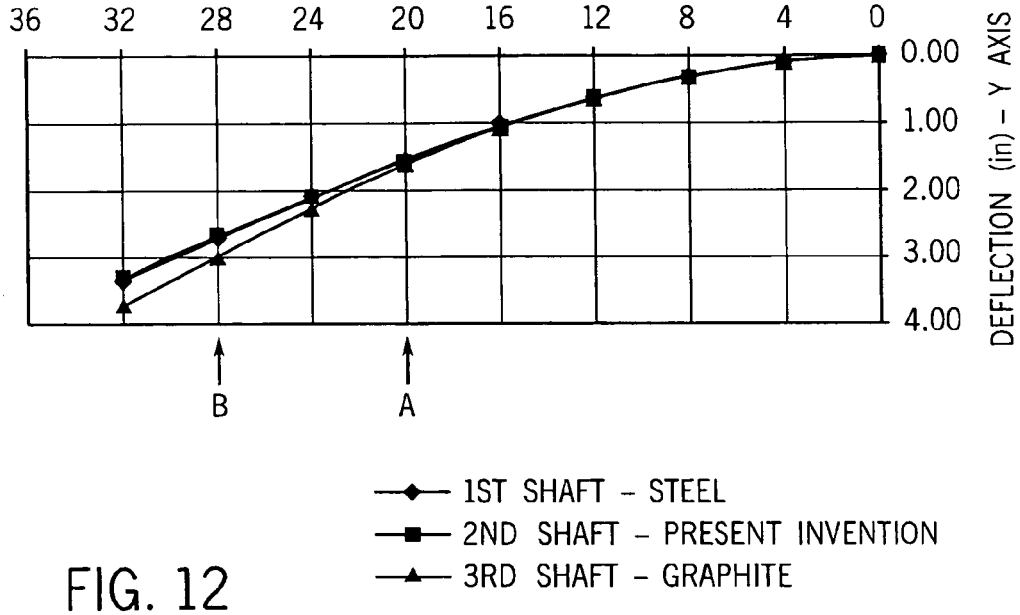
FIG. 12 is a graph illustrating deflection profiles of three separate golf shafts.

FIG. 12 illustrates the results of three separate deflection profiles taken on the same three different shaft configurations as described above. The shaft profiles of FIG. 12 illustrate that the deflection of the three different types of shafts are very comparable. In particular, the deflection profile of the first steel shaft and the second shaft of the pending invention are almost the same, while the third graphite shaft exhibits slightly greater deflection than the first and second shafts. So, the shaft 12 of the present invention mimics or provides the same bending or deflection characteristics as a steel golf shaft without the drawbacks of steel.

The shaft 12 of the present invention provides numerous advantages over existing golf shafts. The shaft 12 provides exceptional control and accuracy and enables the golfer to swing his or her golf club faster thereby generating greater clubhead speed and ball speed. The shaft 12 provides these benefits while being significantly lighter than conventional steel golf shafts. The shaft 12 is also configured for use in competitive play including tournament play by satisfying the requirements of The Rules of Golf as approved by the U.S. Golf Association and the Royal and Ancient Golf Club of St. Andrews, Scotland effective Jan. 1, 2008 ("The Rules of Golf"). Accordingly, the term "shaft is configured for organized, competitive play" refers to a shaft that fully meets the golf shaft rules and/or requirements of The Rules of Golf.

Thus, the present invention provides a golf shaft 12 that provides the control and accuracy of a steel shaft and the corresponding confident feel associated with sensing where the club head is during a swing, without the disadvantages of steel. The present invention also provides a golf shaft 12 with reduced weight and equivalent or better vibrational feel comparable to a graphite shaft but without the disadvantages of a graphite shaft. The unique, co-cured connection of the first and second tubular portions 26 and 28 is a secure, reliable and durable. The dissimilar materials of the first and second portions 26 and 28 along with the co-cured connection provide enhanced dampening of undesirable shock and vibrational energy resulting in a golf shaft having an optimal feel for the user. The unique combination of materials, lengths, sizes, and their connection, provide a unique balance point that enables a higher club swingweight to be attained without increasing actual club weight. The higher club swingweight without corresponding actual weight increase provides additional club construction flexibility. The shaft 12 of the present invention provides the flexibility, weight and feel advantages of a graphite type shaft with the control, accuracy and performance of a steel shaft. The unique construction of the present invention provides these advantages and also enables a golfer to increase his or her swing speed and corresponding ball speed improving the golfer's performance.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. Therefore, the present invention is not limited to the foregoing description but only by the scope and spirit of the appended claims.

What is claimed is:

1. A shaft for an iron or wood golf club, the shaft having a longitudinal axis and capable of being tested under a torsional stability test device, the test device having a first support and a torsional load applicator, the shaft comprising:

a first tubular portion formed of a first material, the first tubular portion having a butt end and a distal end, the distal end of the first tubular portion having an inside diameter, D2'; and a second tubular portion formed of a second material different from the first material, the second tubular portion having a proximal end and a tip end, the tip end having an outside diameter of less than 0.400 inches and the proximal end of the second tubular portion having an outside diameter, D3, the outside diameter, D3, is greater than the inside diameter, D2', such that a mechanical lock is achieved when the inner surface of the distal end of the first tubular portion engage the outer surface of the proximal end of the second tubular portion;

the shaft having a resistance to twisting about the longitudinal axis of the shaft of less than 2.5 degrees, when measured in the torsional stability test device at a point 20 inches from the first support along an exposed length of the shaft, wherein the first support is fixedly secured to approximately 2.25 inches of the shaft at the tip end of the first tubular portion, and wherein the torsional load applicator applies a 1 ft-lb torque to the butt end of the second tubular portion of the shaft, the shaft having a weight within the range of 45 to 95 grams.

2. The shaft of claim 1 wherein the shaft has a resistance to twisting about the longitudinal axis of the shaft of less than 2.0 degrees in the torsional stability test, when measured at the point 20 inches from the first support along the exposed length of the shaft.

3. The shaft of claim 1 wherein the shaft when measured from the tip end of the shaft in a balance point test device has a balance point of less than 50 percent.

4. The shaft of claim 1 wherein the shaft when measured from the tip end of the shaft in a balance point test device has a balance point of less than 46 percent.

5. The shaft of claim 1, wherein the first material is a composite material includes multiple fiber layers, wherein each fiber layer includes a plurality of unidirectional or woven fibers, and wherein the fibers are selected from the group consisting of carbon, glass, basalt, boron, carrot, hemp, Kevlar®, Spectra® and combinations thereof.

6. The shaft of claim 5, wherein the inner most layer of the first tubular portion at or adjacent to the distal end is a glass fiber layer.

7. The shaft of claim 1, wherein the second material is selected from the group consisting of steel, aluminum, titanium, scandium and combinations thereof.

8. The shaft of claim 1 wherein the first tubular portion near the distal end and the second tubular portion near the proximal end each have corresponding tapered constructions such that the second tubular portion cannot extend entirely through the first tubular portion, and wherein the first tubular portion is co-cured over at least a portion of the second tubular portion.

9. The shaft of claim 1 wherein the shaft has a weight within the range of 45 to 95 grams.

10. The shaft of claim 1 wherein the shaft has a resistance to twisting about the longitudinal axis of the shaft of less than 2.0 degrees in the torsional stability test, when measured at a point 28 inches from the first support along the exposed length of the shaft.

11. A shaft for a golf club, the shaft having a total length and comprising:

a first hollow tubular portion formed of a first composite material, the first tubular portion having a butt end region and a tapered distal end region, the first composite material including an galvanic corrosion inhibitor layer positioned as the innermost layer of at least a portion of the tapered distal end region, the first tubular portion extending over at least forty percent of the total length of the shaft; and a second hollow tubular portion formed of a second metallic material, the second tubular portion having a tapered proximal end region and a tip end region, at least a portion of the outer surface of the tapered proximal end region being roughened, the first composite material of the first tubular portion being co-cured to the outer surface of the tapered proximal end region of the second tubular portion, the second tubular portion extending over at least forty percent of the total length of the shaft, the first tubular portion overlapping the second tubular portion to form an overlapped region, the overlapped region being at least one inch and less than four inches in length.

12. The shaft of claim 11 wherein the overlapped region has a length within the range of 2.0 to 2.5 inches.

13. The shaft of claim 11, wherein the shaft when measured from the tip end of the shaft in a balance point test device has a balance point of less than 50 percent.

14. The shaft of claim 11, wherein the shaft when measured from the tip end of the shaft in a balance point test device has a balance point of less than 46 percent.

15. The shaft of claim 11, wherein the first composite material includes multiple fiber layers, wherein each fiber layer includes a plurality of unidirectional or woven fibers, and wherein the fibers are selected from the group consisting of carbon, glass, basalt, boron, carrot, hemp, Kevlar®, Spectra® and combinations thereof.

16. The shaft of claim 15, wherein the galvanic corrosion inhibitor layer is the inner most layer of the first tubular portion at or adjacent to the distal end, and wherein the inner most layer is a glass fiber layer.

17. The shaft of claim 11, wherein the second metallic material is selected from the group consisting of steel, aluminum, titanium, scandium and combinations thereof.

18. The shaft of claim 11, wherein the first composite material of the first tubular portion is co-cured to the outer surface of the tapered proximal end region of the second tubular portion without the use of a separate adhesive.

19. The shaft of claim 11 wherein the shaft has a weight within the range of 45 to 95 grams.

20. The shaft of claim 11, wherein the diameter of the second tubular portion at the tip end is within the range of 0.325 to 0.400 inches.

21. The shaft of claim 11, further comprising a protective ferrule positioned adjacent the distal end of the first tubular portion and about the second tubular portion.

22. The shaft of claim 11, wherein the shaft is configured for organized, competitive play.

23. The shaft of claim 11, wherein the shaft is capable of being tested under a torsional stability test device having a first support and a torsional load applicator, wherein the tip end region has an outside diameter of less than 0.400 inches, wherein the shaft has a resistance to twisting about the longitudinal axis of the shaft of less than 2.5 degrees, when measured in the torsional stability test device at a point 20 inches from the first support along an exposed length of the shaft, wherein the first support is fixedly secured to approximately 2.25 inches of the shaft at the tip end region of the first tubular portion, wherein the torsional load applicator applies a 1 ft-lb torque to the butt end of the second tubular portion of the shaft, and wherein the shaft has a weight within the range of 45 to 95 grams.

24. The shaft of claim 23 wherein the shaft has a resistance to twisting about the longitudinal axis of the shaft of less than 2.0 degrees in the torsional stability test, when measured at the point 20 inches from the first support along the exposed length of the shaft.

25. The shaft of claim 23 wherein the shaft has a resistance to twisting about the longitudinal axis of the shaft of less than 2.0 degrees in the torsional stability test, when measured at a point 28 inches from the first support along the exposed length of the shaft.

26. The shaft of claim 11, wherein the tapered proximal end region of the second tubular portion has an outside diameter that tapers in the overlapped region in a direction from a proximal end of the proximal end region toward the tip end region within a range of 0.010 to 0.015 inch.

27. A golf club comprising:

a shaft including a first tubular portion formed of a first material and a second tubular portion formed of a second material, the first tubular portion having a butt end and a distal end, the second tubular portion having a proximal end and a tip end, the distal end of the first tubular portion coupled to the proximal end of the second tubular portion, the first tubular portion having a weight of within the range of 1.1 to 1.75 grams/inch, and the second tubular portion having a weight within the range of 2.0 to 2.8 grams/inch, the shaft having a balance point of less than 46 percent when measured from the tip end in a balance point test device;

a club head coupled to the tip end of the second tubular portion; and a grip attached to the first tubular portion.

28. The golf club of claim 27, wherein the golf club has a length within the range of 37.0 to 38.5 inches, wherein the club head has a loft angle of 26 to 34 degrees, wherein the golf club having a swing weight rating within the range of C8 to D4 and a total weight within the range of 355 to 385 grams, and a club head weight within the range of 234.5 to 264.5 grams.

29. The golf club of claim 27, wherein the golf club has a length within the range of 38.5 to 40.0 inches, wherein the club head has a loft angle of 16 to 24 degrees, wherein the golf club having a swing weight rating within the range of C8 to D4 and a total weight within the range of 340 to 370 grams, and a club head weight within the range of 218.0 to 248.0 grams.

30. The golf club of claim 27, wherein the golf club has a length within the range of 35.5 to 37.0 inches, wherein the club head has a loft angle of 38 to 46 degrees, wherein the golf club having a swing weight rating within the range of C8 to D4 and a total weight within the range of 385 to 415 grams, and a club head weight within the range of 263.0 to 293.0 grams.

31. The golf club of claim 27, wherein the golf club has a length within the range of 38.5 to 41.5 inches, wherein the club head has a loft angle of 18 to 27 degrees, wherein the golf club having a swing weight rating within the range of C8 to D4 and a total weight within the range of 335 to 365 grams, and a club head weight within the range of 215.0 to 245.0 grams.

32. The golf club of claim 27 wherein the first tubular portion overlaps the second tubular portion to form an overlapped region, and wherein the overlapped region has a length within the range of 2.0 to 2.5 inches.

33. The golf club of claim 27, wherein the first composite material includes multiple fiber layers, wherein each fiber layer includes a plurality of unidirectional or woven fibers, and wherein the fibers are selected from the group consisting of carbon, glass, basalt, boron, carrot, Kevlar®, Spectra® and combinations thereof.

34. The golf club of claim 27, wherein the inner most layer of the first tubular portion at or adjacent to the distal end is a glass fiber layer.

35. The golf club of claim 27, wherein the second metallic material is selected from the group consisting of steel, aluminum, titanium, scandium and combinations thereof.

36. The golf club of claim 27, wherein the first composite material of the first tubular portion being applied about and cured to the outer surface of the tapered proximal end region of the second tubular portion.

37. The golf club of claim 27, further comprising a protective ferrule positioned adjacent the distal end of the first tubular portion and about the second tubular portion.

38. The golf club of claim 27, wherein the shaft is configured for organized, competitive play.

39. The shaft of claim 11, wherein the distal end region of the first tubular portion has an inside diameter, D2', wherein the proximal end region of the second tubular portion having an outside diameter, D3, wherein the outside diameter, D3, is greater than the inside diameter, D2', such that a mechanical lock is achieved when the inner surface of the distal end region of the first tubular portion overlaps the outer surface of the proximal end of the second tubular portion.

40. The shaft of claim 39, wherein the first tubular portion near the distal end region and the second tubular portion near the proximal end region each have corresponding tapered constructions such that the second tubular portion cannot extend entirely through the first tubular portion.

* * * * *